US006256808B1

(12) United States Patent
Graham et al.

(10) Patent No.: US 6,256,808 B1
(45) Date of Patent: Jul. 10, 2001

(54) SHOWER POST ADJUSTMENT MECHANISM

(75) Inventors: Gary E. Graham, Sheboygan; Michael G. Cook, Kohler, both of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/545,113

(22) Filed: Apr. 6, 2000

(51) Int. Cl.[7] ..... A47K 3/28
(52) U.S. Cl. ..... 4/615; 4/567; 4/601
(58) Field of Search ..... 4/567, 568, 570, 4/599, 601, 605, 615; 248/80; 239/195, 281; 384/29, 42

(56) References Cited

U.S. PATENT DOCUMENTS

| | | | | |
|---|---|---|---|---|
| 1,758,115 | * | 5/1930 | Kelly | 4/615 X |
| 1,982,509 | | 11/1934 | Frank | 4/596 X |
| 2,685,093 | | 8/1954 | Lundquist | 4/615 |
| 2,697,839 | | 12/1954 | Jackson | 4/615 |
| 3,616,466 | | 11/1971 | Davis | 4/615 |
| 3,737,107 | | 6/1973 | Wright | 4/615 X |
| 3,806,963 | | 4/1974 | Flynn | 4/615 |
| 3,971,074 | | 7/1976 | Yxfeldt | 4/601 X |
| 4,171,094 | | 10/1979 | Halfen | 4/615 X |
| 4,271,543 | | 6/1981 | Martin | 4/615 |
| 4,360,159 | | 11/1982 | Haynes | 4/601 X |
| 4,554,690 | | 11/1985 | Knapp et al. | 4/615 X |
| 5,035,010 | | 7/1991 | Sakamoto et al. | 4/615 X |
| 5,070,549 | | 12/1991 | Campe | 4/601 X |
| 5,073,996 | | 12/1991 | Schinle | 4/601 |
| 5,418,985 | | 5/1995 | Antoine | 4/615 |

* cited by examiner

*Primary Examiner*—Robert M. Fetsuga
(74) *Attorney, Agent, or Firm*—Quarles & Brady LLP

(57) ABSTRACT

Disclosed herein is a shower system having at least one showerhead mounted on large candy cane-shaped showerhead posts in which flexible water lines are disposed. A counterbalanced bearing mechanism for each tube permits the position the showerheads to be adjusted by simply rotating, raising and/or lowering the showerhead posts as needed. The counterbalance assembly automatically maintains the vertical position of the tube and the bearing hold the tube at the desired angle.

11 Claims, 4 Drawing Sheets

FIG. 1
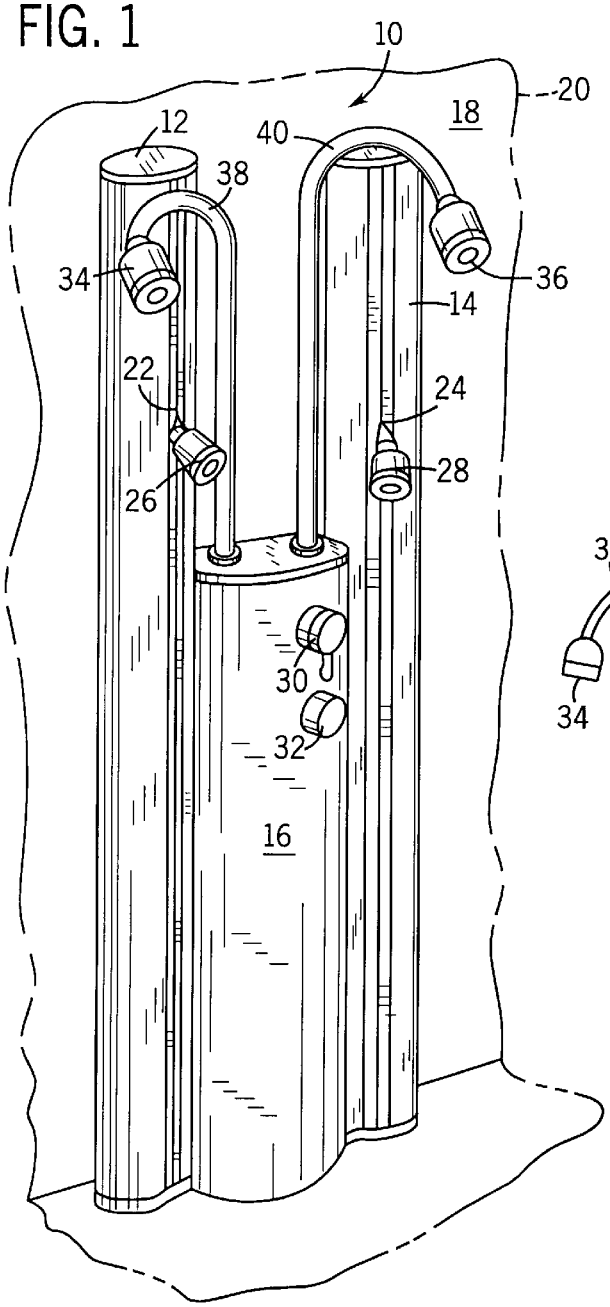
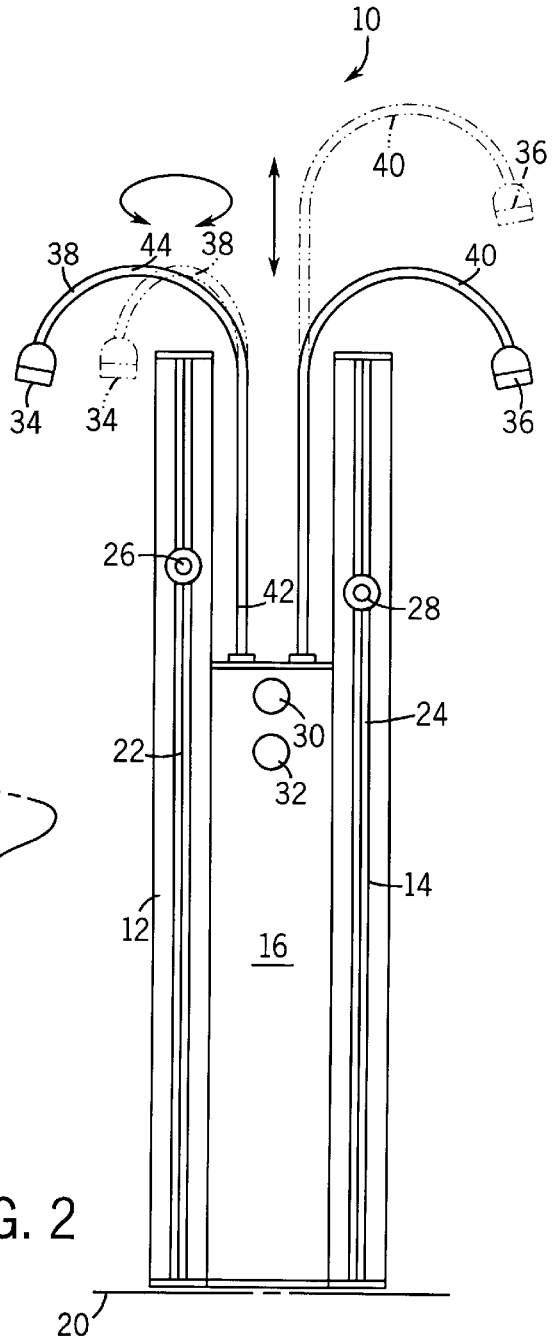
FIG. 2

FIG. 3
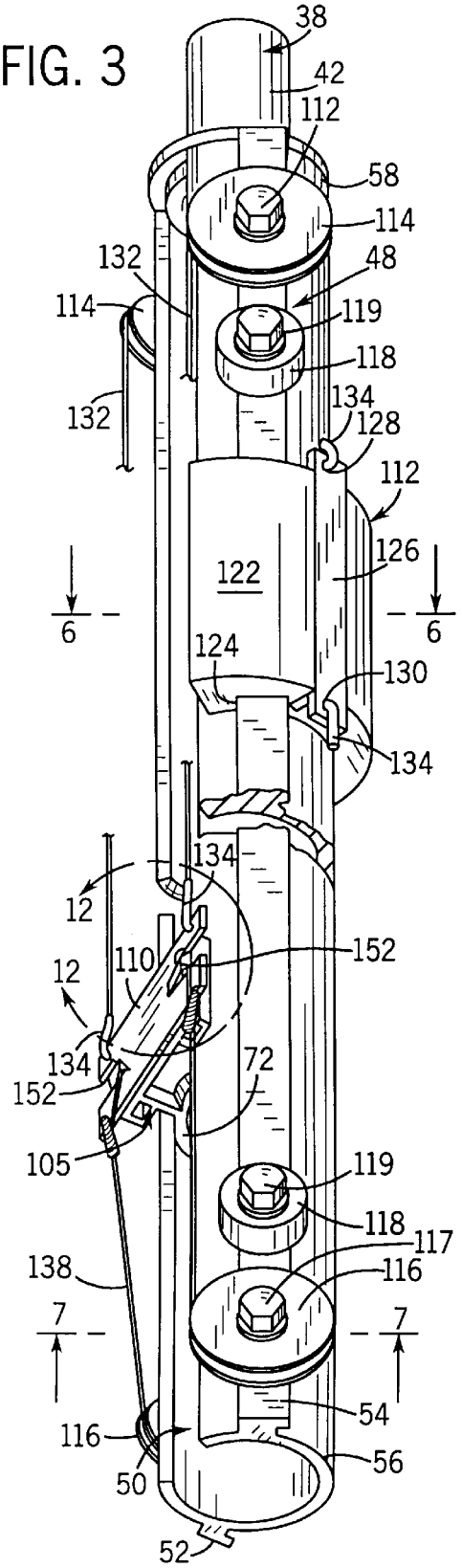
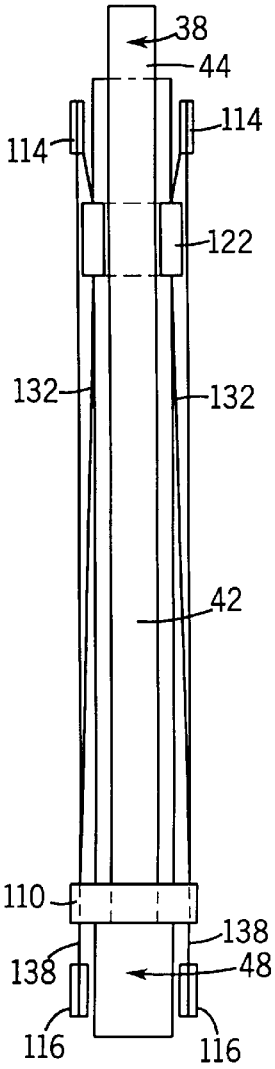
FIG. 4A
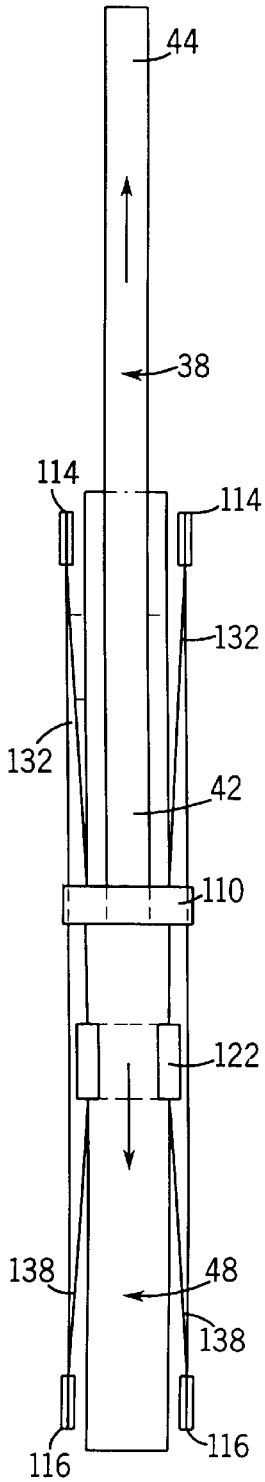
FIG. 4B

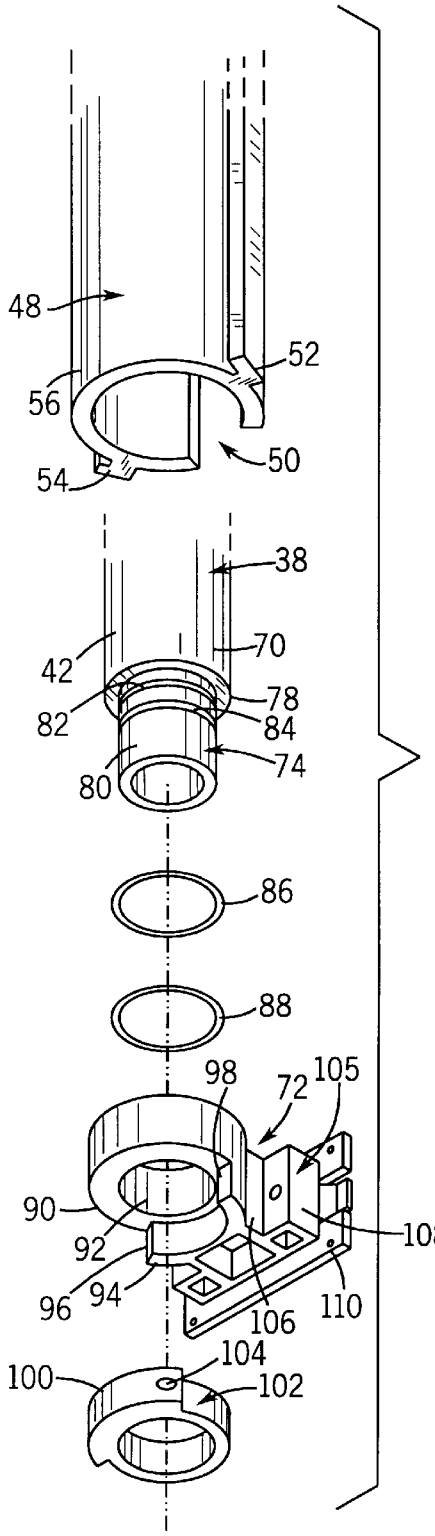
FIG. 5
FIG. 6
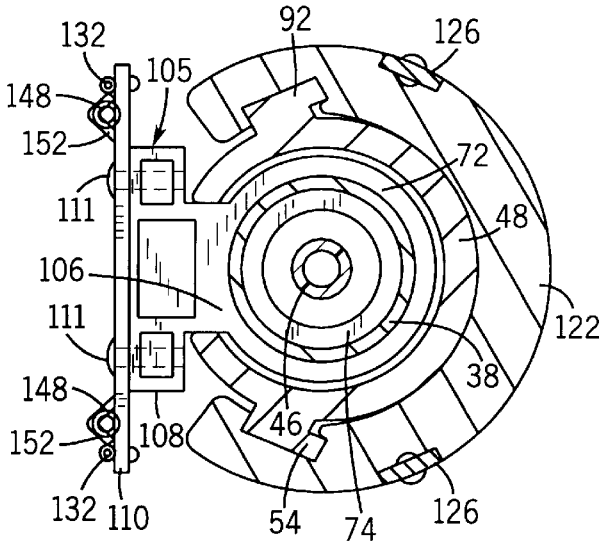
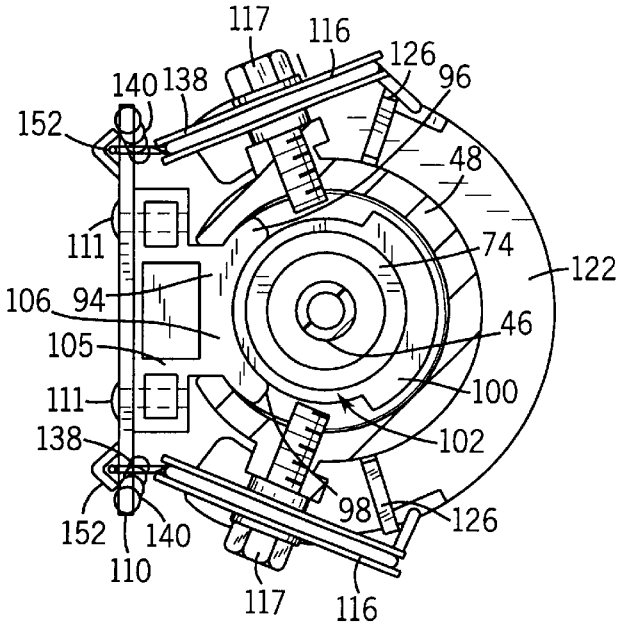
FIG. 7

FIG. 10
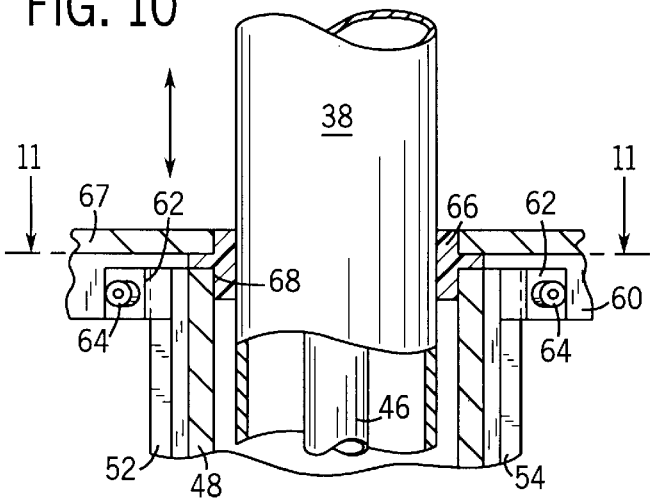
FIG. 11
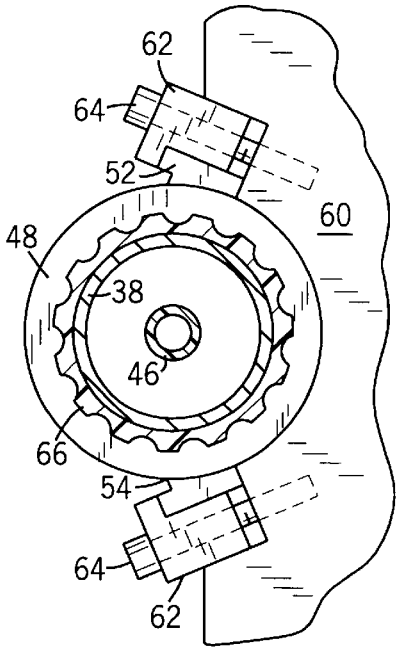
FIG. 8
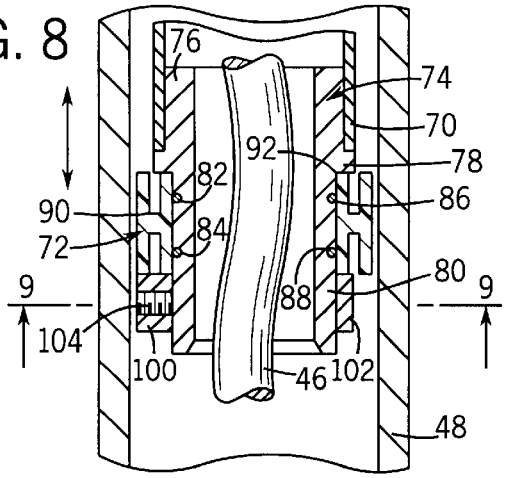
FIG. 12
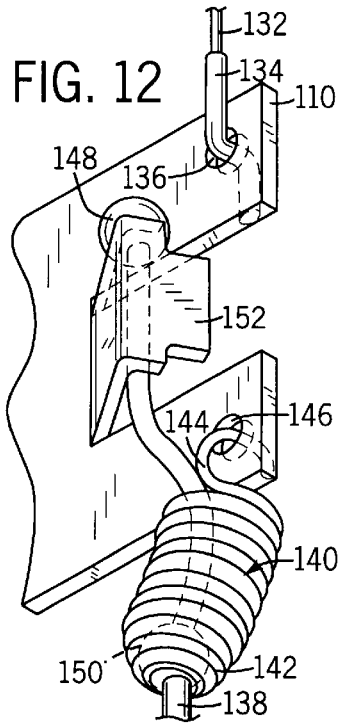
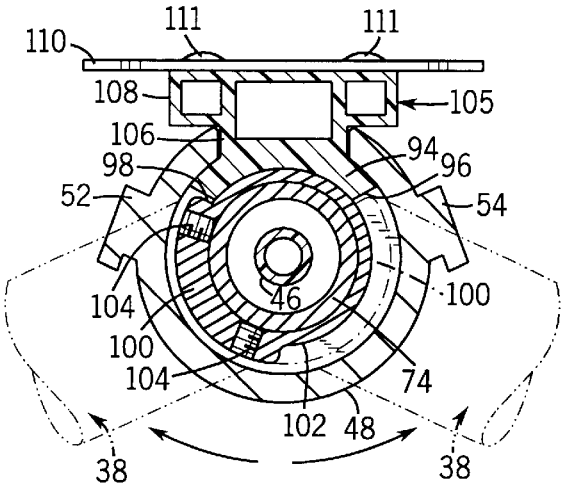
FIG. 9

SHOWER POST ADJUSTMENT MECHANISM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to shower systems, and in particular to mechanisms for positioning and supporting a shower post.

People commonly shower while standing in a tub enclosure or shower stall. The main showerhead is usually mounted on the wall to shower water down upon the person's head and body. However, the head is usually positioned to best accommodate people of average height. This can require individuals of large stature to bend down and duck their heads under the showerhead to wash their hair or faces. For children and shorter adults showerheads at this height may splash into their faces or be at an undesirably low pressure when the water reaches their bodies.

It is also known to attach a showerhead to a plumbing supply line via a hose or other flexible conduit to create what is known as a personal shower. The showerhead may be removed from a fixed shower wall mount and held by the hand during showering. However, this requires the bather to assign one hand to holding the spray head. This makes it more difficult to use shampoo, or shave, or use soap, at the same time.

In another approach showerheads have been attached to a rod so as to be vertically slidable along the rod. However, these systems typically require the user to loosen and re-tighten fasteners to adjust the height of the showerhead and secure it in the adjusted position.

Other shower systems provide a height adjustment mechanism in which the user can lift or lower the showerhead and the showerhead is held in a new position. See e.g. U.S. Pat. Nos. 4,360,159 and 2,685,093. Yet, such shower systems typically do not permit the stem or post of the showerhead to be rotated. Thus, the spray direction of the shower can only be adjusted at the pivot joint of the showerhead.

Accordingly, there exists a need for a further improved shower system having an adjustment mechanism in which both the height and angular direction of the showerhead can be easily adjusted.

BRIEF SUMMARY OF THE INVENTION

The present invention provides a shower system having an adjustment mechanism which facilitates vertical and angular repositioning of the showerhead. The adjustment mechanism automatically holds the shower held in the adjusted position.

In one aspect the invention provides an adjustable showerhead which has a stationary sleeve defining an axial pathway, and a bearing disposed within the sleeve and axially slidable along the axial pathway, the bearing having an axial bore defining an inner race.

There is also a showerhead post having an upper end attached to a showerhead and an opposite end rotatably disposed within the bearing inner race while being essentially fixed in an axial position with respect to the bearing.

In a preferred aspect there is also a counter balance assembly. The sleeve includes a vertical slot and the bearing includes a tab extending through the slot. The counter balance assembly is attached to the bearing tab so as to assist in maintaining the vertical position of the showerhead post.

The counter balance assembly has a weight, an upper pulley, a lower pulley, an upper cable riding within the upper pulley and coupled to the bearing and to the weight, and a lower cable riding within the lower pulley and coupled to the bearing and to the weight. When the showerhead post moves up the weight moves down, and vice versa.

The sleeve has an axial track at its outer periphery along which the weight travels, and a cable attachment plate can be mounted to the bearing tab. There can also be a spring coupled to an end of the lower cable and to attachment plate, and the lower cable can have a ball tip at an end adjacent the bearing. There can also be a bracket mounted to the weight such that upper and lower cables are connected to the bracket via hooks.

In other aspects there can be an annular bearing fixed at an upper end of the sleeve and having an axial bore through which the showerhead post rides for further guiding the showerhead post within the sleeve. There can also be at the lower end of the showerhead post a coupler. The coupler has a first end fixedly disposed within the showerhead post, a second end disposed with the bearing bore, and an annular shoulder between the first and second coupler ends for abutting the showerhead post on one side and a top surface of the bearing on the opposite side.

In yet another aspect there can be a travel stop secured to the bottom end of the showerhead post adjacent the bearing for restricting the showerhead's upward and axial rotational movement.

The showerhead post is a hollow, open-ended tube in which a flexible water line can be positioned. The water line extends from a water valve to a showerhead mounted at an upper end of the showerhead post.

Preferably, friction elements, such as resilient o-rings, are fit between the coupler and the axial bore of the bearing to prevent unintended pivot within the bearing.

Thus, the shower system of the present invention permits the height of the showerhead to be easily and simply adjusted by lifting or pulling down on the upper (preferably curved) end of the showerhead post. The showerhead post stays in the adjusted position by operation of the counterbalance system without the need to adjust fasteners or otherwise additionally secure the showerhead post. The showerhead post can also be easily rotated by pivoting the upper end. The showerhead post is held at the adjusted rotational angle by friction between the bearing and the end of the showerhead post.

The foregoing and other advantages of the invention will appear from the following description. In this description reference is made to the accompanying drawings which form a part hereof and in which there is shown by way of illustration preferred embodiments of the invention. These embodiments do not represent the full scope of the invention. Thus, the claims should be looked to in order to judge the scope of the invention.

BRIEF DESCRIPTION OF THE DRAWINGS

FIG. 1 is a perspective view of a shower system having two adjustable showerhead posts of the present invention;

FIG. 2 is a front plan view of the FIG. 1 shower system of FIG. 1;

FIG. 3 is a fragmented perspective view of the adjustment mechanism for one of the showerhead posts;

FIG. 4A is a schematic view of the counterbalancing system of the adjustment mechanism of FIG. 3, shown with the showerhead post lowered completely;

FIG. 4B is a schematic view as in FIG. 4A, albeit shown with the showerhead post raised completely;

FIG. 5 is an exploded view of a bearing assembly at the lower end of such a showerhead post;

FIG. 6 is a cross-sectional view taken along line 6—6 of FIG. 3;

FIG. 7 is a cross-sectional view taken along line 7—7 of FIG. 3;

FIG. 8 is a vertical cross-sectional view of the FIG. 3 embodiment;

FIG. 9 is a cross-sectional view taken along line 9—9 of FIG. 8;

FIG. 10 is a partial vertical cross-sectional view showing a showerhead post within an upper guide bearing;

FIG. 11 is a cross-sectional view taken along line 11—11 of FIG. 10; and FIG. 12 is a break-away perspective view, taken along arc 12—12 of FIG. 3, showing a counter weight cable attached to a cable attachment plate.

DETAILED DESCRIPTION OF THE PREFERRED EMBODIMENTS

Referring to FIGS. 1 and 2, the shower system 10 of the present invention includes peripheral column housings 12 and 14 flanking a main housing 16. These are suitably mounted to a bathroom wall (or alternatively to wall 18 of a shower stall 20). The column housings 12 and 14 have vertical openings 22 and 24 for body spray nozzles 26 and 28, respectively.

The main housing 16 mounts a hot and cold water mixing valve 30 and spray diverter 32 for selecting between water flow to the body spray nozzles 26 and 28 and a pair of showerheads 34 and 36 mounted on adjustable candy cane shaped showerhead posts 38 and 40. The showerhead posts 38 and 40 are identical and are supported by identical support and adjustment mechanisms mounted in parallel within the main housing 16. Thus, for simplicity, only one showerhead post and corresponding adjustment mechanism will be described in detail below.

Showerhead post 38 is a hollow tube, preferably made of chrome-plated brass, having a straight end 42 disposed within the main housing 16 and a curved end 44 to which the showerhead 34 is pivotably attached. The showerhead post 38 thus forms a cane shape. The showerhead post 38 is designed to contain a flexible water line 46 (see FIG. 8) suitably coupled to the showerhead 34 at one end and to the mixing valve 30 at its other end.

Referring to FIGS. 3 and 5, the straight end 42 of the showerhead post 38 is disposed within a guide sleeve 48, preferably made of extruded aluminum, mounted vertically within the main housing 16. The guide sleeve 48 is generally cylindrical with a lengthwise slot 50 and a pair of lengthwise outer guide rails 52 and 54. A bottom end 56 of the guide sleeve 48 is disposed within a recess in a bottom mounting plate (not shown). Referring to FIGS. 10 and 11, an upper end 58 of the guide sleeve 48 is mounted to an upper mounting plate 60 by L-clips 62 fastened over the guide rails 52 and 54 by cap screws 64.

Referring next to FIGS. 5, 6 and 8, the straight end 42 of the showerhead post 38 is disposed within the guide sleeve 48 and centered by an annular upper bearing 66, preferably made of nylon, secured at an opening 68 in the upper end 58 of the guide sleeve 48 by a cover plate 67 (see FIG. 10). At a bottom end 70 of the straight end 42, the showerhead post 38 is rotatably mounted in and to a lower bearing 72 disposed within the inner diameter of the guide sleeve 48.

The bottom end 70 of the showerhead post 38 is attached to the lower bearing 72 by a brass coupler 74 having a cylindrical upper end 76 fit within the inner diameter of the showerhead post 38. The coupler 74 has a central circumferential shoulder 78 with the same outer diameter as the showerhead post 38 and a cylindrical lower end 80 having a decreased diameter. The lower end 80 has two circumferential grooves 82 and 84 each containing a resilient annular seal 86 and 88, respectively.

The lower bearing 72 is preferably made of a glass-filled nylon material and has an annular body 90 with an outer diameter sized to fit within the guide sleeve 48. The annular body 90 includes an axial bore 92 therethrough defining an inner race having a diameter sized to receive the lower end 80 of the coupler 74. Thus, the lower bearing 72 can slide up and down within the guide sleeve 48 and the coupler 74 (and thereby the showerhead post 38) can rotate within the lower bearing 72 while remaining essentially fixed in an axial position with respect to the lower bearing 72. The annular seals 86 and 88 provide a suitable amount of friction to prevent the showerhead post 38 from unintentionally being rotated by the force (approximately 3 pounds) of the water passing through the showerhead 34.

Referring to FIGS. 7, 8 and 9, below the annular body 90 of the lower bearing 72 is an arcuate member 94 terminating at stop surfaces 96 and 98. These stop surfaces 96 and 98 contact a travel stop 100 of an annular locking collar 162 fastened to the lower end 80 of the coupler 74 below the annular body 90 of the lower bearing 72 by a pair of set screws 104. The locking collar 102 prevents the showerhead post 38 from being pulled upward though the lower bearing 72 during use.

Moreover, referring to FIG. 9, the travel stop 100 rotates in unison with showerhead post 38 and contacts the stop surfaces 96 and 98 of the arcuate member 94 to limit the rotation of the showerhead post 38 through a prescribed angle, preferably 90 degrees or less. For each showerhead post 38, the locking collar 102 is attached at the proper orientation to limit the rotation in either direction as needed to prevent the shower post from hitting a door, wall or other structure in the shower stall 20. This setting will typically vary for each showerhead post 38, but depends upon the specific application.

Referring to FIGS. 3, 6 and 7, extending radially outward from the annular body 90 and arcuate member 94 of the lower bearing 72 is a T-shaped tab 105 having a stem 106 sized to ride within the opening 50 of the guide sleeve 48 and a perpendicular cross-member 108 to which a stainless steel cable attachment plate 110 is mounted via threaded fasteners 111. The cable attachment plate 110 joins the lower bearing 72 to a counterbalance system 112 mounted to the guide rails 52 and 54 of the guide sleeve 48.

Referring to FIGS. 3, 4A, 4B, 6 and 7, the counterbalance system 112 includes a pair of upper 114 and lower 116 pulleys, preferably made of nylon, mounted at the top and bottom of the guide sleeve 48 by bolts 117 threaded into openings through the guide rails 52 and 54. Spaced inwardly form each pulley 114 and 116 is a rubber ring bumper 118 also fastened by bolts 119 threaded into openings in the guide rails 52 and 54. A split annular counterweight 122 has longitudinal grooves 129 for mating with the guide rails 52 and 54 so that the counterweight 122 can travel up and down along the guide sleeve 48 between the bumpers 118. A pair of U-shaped brackets 126 (one shown) fit into recesses in the counterweight 122 and have top 128 and bottom 130 openings.

A pair of upper cables 132 attach at one end to the top openings 128 in the counterweight brackets 126 at Z-hooks 134. The upper cables 132 extend from the counterweight brackets 126 up and around the corresponding upper pulley 114 and back down to the cable attachment plate 110 mounted to the lower bearing 72. The upper cables 132 are attached to the cable attachment plate 110 via Z-hooks 134 disposed within a pair of upper openings 136.

Referring to FIGS. 3 and 12, a pair of lower cables 138 extend from Z-hooks 134 attached to the bottom openings 130 in the counterweight brackets 126 down and around the corresponding lower pulleys 116 up to the cable attachment plate 110. Each of the lower cables 138 are in part attached to the cable attachment plate 110 by an extension spring 140 having a tapered bottom end 142 and hook 144 at a top end disposed within a lower opening 146 in the cable attachment plate 110.

Each of the lower cables 138 includes an upper ball 148 and a lower ball 150 spaced apart from each other. Each cable is inserted through the center of the corresponding spring 140 so that the lower ball 150 is captured by the tapered end 142 of the spring 140 and the upper ball 148 extends through the spring 140 and is captured by a clip 152 in the cable attachment plate 110.

The distance between the two balls 148 and 150 of the each lower cable 138 is larger than the distance between the clip 152 and the tapered end 142 of the springs 120 before extension so that the lower cables 138 are slacked between the upper 148 and lower 150 balls. This allows the springs 120 to extend and dampen the shock that would otherwise occur if the counterweight 122 were to contact either bumper abruptly.

Referring to FIGS. 4A and 4B, in this way, as the showerhead post 38 is raised or lowered, the lower bearing 72 slides within the guide sleeve 48. In response to this movement, the upper 132 or lower 138 cables pull the counterweight 122 in an opposite direction that the showerhead post 38 is traveling. This provides a countervailing upward force equal and opposite to the weight of the showerhead post 38 and the components supported thereby.

Thus, the present invention provides for a pair of showerhead posts 38 and 40 that can be freely rotated, raised and lowered by simply grasping the curved end 44 of the showerhead posts 38 and 40 and/or the showerheads 34 and 36 themselves and moving the showerheads 34 and 36 to the desired position. The counterbalance systems 112 apply the appropriate counter-acting force on the showerhead posts 38 and 40 to maintain the showerheads 34 and 36 at the adjusted height. The annular seals 86 and 88 keep the showerhead posts 38 and 40 at the adjusted angle.

While there has been shown and described what is at present considered to be the preferred embodiment of the invention, it will be evident from the above description to the those skilled in the art that various changes and modifications can be made to the described device without departing from the scope of the present invention. Accordingly, to ascertain the full scope of the invention, reference must be had to the following claims.

INDUSTRIAL APPLICABILITY

The above disclosure provides a spout mounted on a rod that can easily be rotationally and vertically adjusted.

We claim:

1. An adjustable showerhead, comprising:

a stationary sleeve defining an axial pathway;

a bearing disposed within the sleeve and axially slidable along the axial pathway, the bearing having an axial bore defining an inner race; and a showerhead post having an upper end attached to a showerhead and an opposite end that is freely rotatable during normal use within the bearing inner race during use while being essentially fixed in an axial position with respect to the bearing.

2. The showerhead of claim 1, further comprising a travel stop secured to the bottom end of the showerhead post adjacent the bearing for restricting the showerhead's upward and axial rotational movement.

3. An adjustable showerhead, comprising:

a stationary sleeve defining an axial pathway;

a bearing disposed within the sleeve and axially slidable along the axial pathway, the bearing having an axial bore defining an inner race;

a showerhead post having an upper end attached to a showerhead and an opposite end rotatably disposed within the bearing inner race while being essentially fixed in an axial position with respect to the bearing; and a counter balance assembly;

wherein the sleeve includes a vertical slot and the bearing includes a tab extending through the slot;

wherein the counter balance assembly is attached to the bearing tab so as to assist in maintaining the vertical position of the showerhead post.

4. The showerhead of claim 3, wherein the counter balance assembly comprises:

a weight;

an upper pulley;

a lower pulley;

an upper cable riding within the upper pulley and coupled to the bearing and to the weight; and a lower cable riding within the lower pulley and coupled to the bearing and to the weight;

whereby when the showerhead post moves up the weight moves down, and vice versa.

5. The showerhead of claim 4, wherein the sleeve has an axial track at its outer periphery along which the weight travels.

6. The showerhead of claim 4, further comprising a cable attachment plate mounted to the bearing tab.

7. The showerhead of claim 6, further comprising a spring coupled to an end of the lower cable and to attachment plate.

8. The showerhead of claim 7, wherein the lower cable has a ball tip at an end adjacent the bearing.

9. The showerhead of claim 8, further comprising:

a bracket mounted to the weight;

wherein the upper and lower cables are connected to the bracket via hooks.

10. An adjustable showerhead, comprising:

a stationary sleeve defining an axial pathway;

a bearing disposed within the sleeve and axially slidable along the axial pathway, the bearing having an axial bore defining an inner race;

a showerhead post having an upper end attached to a showerhead and an opposite end rotatably disposed within the bearing inner race while being essentially fixed in an axial position with respect to the bearing; and an annular bearing fixed at an upper end of the sleeve and having an axial bore through which the showerhead post rides for further guiding of the showerhead post within the sleeve.

11. An adjustable showerhead, comprising:

a stationary sleeve defining an axial pathway;

a bearing disposed within the sleeve and axially slidable along the axial pathway, the bearing having an axial bore defining an inner race;

a showerhead post having an upper end attached to a showerhead and an opposite end rotatably disposed within the bearing inner race while being essentially fixed in an axial position with respect to the bearing; and wherein a lower end of the showerhead post comprises:

a coupler having a first end fixedly disposed within the showerhead post, a second end disposed with the bearing bore, and an annular shoulder between the first and second coupler ends for abutting the showerhead post on one side and a top surface of the bearing on the opposite side.

* * * * *